United States Patent [19]

Morse

[11] 4,091,976

[45] May 30, 1978

[54] GARMENT BAG HOLDER

[76] Inventor: Clarence Wesley Morse, 5598 Naples Canal, Long Beach, Calif. 90803

[21] Appl. No.: 780,262

[22] Filed: Mar. 23, 1977

[51] Int. Cl.[2] ..... B65D 69/00

[52] U.S. Cl. ..... 224/45 R; 206/279; 248/317; 24/128

[58] Field of Search ..... 224/45 P, 45 T, 45 Q, 224/45 W, 45 R, 55, 56, 57, 58, 49, 29 C, 42.45 A, 42.46 R, 42.46 A, 115 H, 128; 211/113, 114–119, 168, 170; 248/214, 215, 317, 59, 60, 328; 206/279, 284, 285, 288, 289, 290, 291, 300; 190/60

[56] References Cited

U.S. PATENT DOCUMENTS

| | | | |
|---|---|---|---|
| 882,722 | 3/1908 | Stark | 224/56 X |
| 1,967,560 | 7/1934 | Oberg | 224/57 |
| 2,521,037 | 9/1950 | Brinton | 248/215 X |
| 2,629,529 | 2/1953 | Threeton | 224/45 T |
| 2,997,217 | 8/1961 | Levy | 248/328 X |
| 3,731,809 | 5/1973 | Saenger | 224/45 T |

FOREIGN PATENT DOCUMENTS

| | | | |
|---|---|---|---|
| 319,336 | 7/1934 | Italy | 206/284 |
| 445,970 | 3/1968 | Switzerland | 248/59 |
| 15,468 of | 1885 | United Kingdom | 224/57 |
| 1,225,815 | 3/1971 | United Kingdom | 24/128 |

*Primary Examiner*—Drayton E. Hoffman
*Assistant Examiner*—Donald W. Underwood
*Attorney, Agent, or Firm*—Fulwider, Patton, Reiber, Lee & Utecht

[57] ABSTRACT

There is disclosed a garment bag holder including a rigid grasp handle formed centrally with an elongated through aperture which also projects toward one end thereof to form an upwardly opening hook-receiving slot. A transverse pivot pin is mounted centrally in the handle projecting through the aperture and has one end of a suspension hook looped thereabout to form a pivot eye encircling the pin and project therefrom to form a shank terminating in a looped back hook which may be pivoted between a retracted position disposed longitudinally in such slot aperture and an operative position projecting transversely from the handle. A slip noose is connected with the hook pivot eye for receipt of coat hanger hooks projecting from a garment bag and arranged to tighten thereon under the weight of garments on such coat hangers.

6 Claims, 2 Drawing Figures

GARMENT BAG HOLDER

BACKGROUND OF THE INVENTION

1. Field of the Invention

The garment bag holder of the present invention relates to a handle device to be utilized in carrying a garment bag during travel and the like.

2. Description of the Prior Art

Numerous different types of garment bags have been proposed and a commonly used garment bag is of the flexible plastic bag type having an opening at the top thereof for projection therethrough of the hooks of clothes hangers which are normally grasped by the traveler during toting of his garment bag to and from his automobile, aircraft, and the like. It is not uncommon for such a clothes bag to contain 10, 15 or even 20 pounds of clothing and any traveler grasping such clothes hangers by his bare hands can testify to the discomfort attendant the extensive carrying times with the hooks biting into his hands. The present invention is directed to a portable, compact holder which may conveniently be folded and carried in a traveler's pocket, or the like and, when it is desirous to lift such a garment bag, the coat hanger hooks may be hooked to the handle of the holder for toting thereof and upon reaching of a destination, as for instance, a hotel closet, the holder itself may be hung from the clothes rod in the closet with the hangers remaining suspended therefrom. While numerous different types of holders incorporating rigid handles and flexible transversely extending loops have been proposed for various applications, applicant is not aware of any prior art garment bag holders incorporating a rigid handle formed centrally with a through aperture which projects toward one end of such handle to form a blind slot for recessing therein of a rigid suspension hook which may be pivoted up to project to one side of the handle and also having a slip noose projecting from the opposite side thereof.

SUMMARY OF THE INVENTION

The garment bag holder of the present invention is characterized by an elongated rigid handle formed with an elongated slot having a pivot pin projecting thereacross for receipt centrally therearound of an eye formed in one end of a suspension hook such that the hook itself may be pivoted between a recessed position in the slot and an operative position projecting transversely from the handle for hooking over a closet rod or the like. A hanger noose is connected with the pivot pin and projects from the aperture in the direction opposite the operative position of the suspension hook for receipt in such noose of coat hanger hooks projecting from a garment bag.

DESCRIPTION OF THE PREFERRED EMBODIMENT

Figure 1:
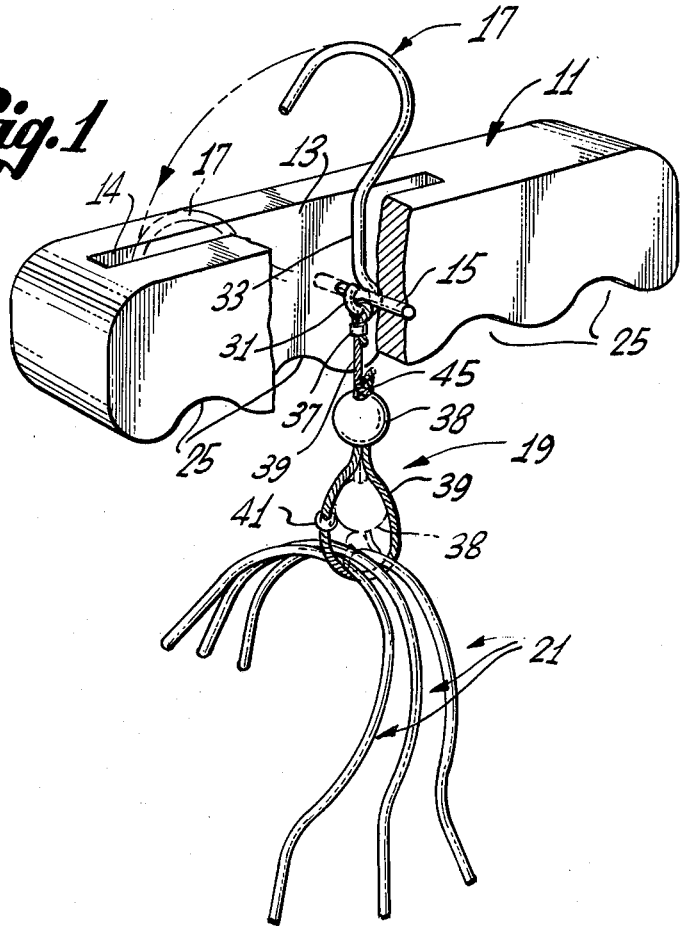
FIG. 1 is a perspective view of a garment bag holder embodiment of the present invention.

The garment bag holder of the present invention includes, generally, an elongated rigid handle 11 having a through aperture 13 formed centrally therein and projecting toward an end of the handle to form an upwardly opening longitudinal blind cavity 14 offset to one end thereof. A pivot pin 15 is disposed centrally in the handle 11 and projects transversely across the aperture 13 for securement thereabout of one end of a suspension hook 17. A slip noose, generally designated 19, projects from the side of the aperture 13 opposite that from which the hook 17 extends for receipt of the hooks formed by coat hangers 21 projecting from the top extremity of a garment bag (not shown). Consequently, the suspension hook 17 may conveniently be pivoted downwardly to its retracted position within the slot 14 for convenient storage of the holder in a user's pocket. When it is desirable to use such holder, as for instance in transferring a garment bag holder from the automobile to a hotel room, the holder may be withdrawn from the user's pocket, the noose 19 opened and the hooks of the coat hangers 21 fitted therethrough and the handle 11 grasped with the noose 19 projecting between the second and third fingers of the hand and such noose drawn tight. When the closet is reached the suspension hook 17 may be rapidly pivoted upwardly to its solid line operative position shown in FIG. 1 for hooking over a closet hanger rod (not shown).

The handle 11 may be constructed of any desirble material, as for instance plastic, wood, or the like, and may be generally of rectangular cross section with the bottom side thereof being scalloped to form finger grip depressions 25 for comfortable grasping thereof. The handle 11 is formed centrally with the through aperture 13, which is generally rectangular as viewed from the top of the handle 11 in FIG. 1 and projects downwardly into the handle 11 and, if desirable, may project entirely transversely through the handle 11 in the general area of the pivot pin 15.

The cavity 14 projects toward one end of the handle 11 and is blind on its bottom end to limit downward pivoting of the hook 17 so it won't pivot out the bottom of the handle 11 leaving the end thereof exposed to catch on the pocket lining of the user and making it more comfortable for handling thereof.

The suspension hook 17 is preferably of wire construction and is formed at its bottom extremity with an eye 31 which loosely surrounds the pivot pin 15 and then projects thereawayfrom to form a straight shank 33 and then finally turns generally back on itself to form the hook itself. It will be appreciated that the hook 17 is about one half the size of the hooks of conventional coat hangers 21 to thus somewhat miniaturize the size of the handle 11 so the hook 17 may be fully retracted to thus form a compact holder which may be conveniently carried in the user's pocket without bulk or annoyance.

Figure 2:
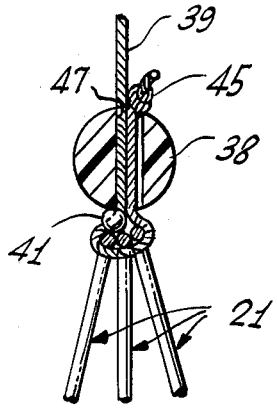
FIG. 2 is a longitudinal sectional view taken through the slip bead incorporated in the garment bag holder shoen in FIG. 1.

The noose 19 is preferably constructed of 1/16 inch diameter flexible nylon cord or the like and is looped on one end about the suspension hook eye 31 and secured by means of a clamping collar 37 and then projects downwardly through a $\frac{3}{8}$ inch bore formed in a $\frac{3}{8}$ inch diameter slip bead 38 to form a shank 39 and then turns back on itself to project through a bore formed in a 3/16 inch diameter stop bead 41 and then projects back through the bore in the slip bead 38, coextensive with the shank 39, to finally terminate in a restrictive knot 45 (FIG. 2) which is drawn partially into the bore of the stop bead 38 to frictionally lock such knot wedged against the shank 39 holding the hanger hooks 21 securely in position but limiting pulling entirely therethrough.

In operation, the handle 11 is normally about three to four inches long and about three-quarters of an inch square in cross section to thus be conveniently carried in the user's pocket, with the suspension hook nearly fully retracted within the aperture 13. When a traveler desires to transfer his garment bag, as to an automobile, he may withdraw such holder from his pocket and insert the coat hanger hooks in the noose 19 with such noose in its expanded solid line condition shown in FIG. 1. The handle 11 may then be grasped to lift the hangers upwardly, thus drawing the loop cord upwardly through slip bead 38 to thus tighten the noose about the coat hanger hooks and drawing the noose to its tightened position shown in broken line, with the knot 45 locking it in position, in FIG. 1. With the noose 19 so tightened, the hangers 21 are secure from accidentally unhooking therefrom and being accidentally dropped. The traveler may thus carry his garment bag to his car without experiencing the normal discomfort and circulation restricting pressures resulting from direct grasping of coat hanger hooks, particularly when the garment bag weight exceeds about ten pounds. When the car is reached, the projecting portion of the hook 17 may be grasped to pivot such hook to its extended position and the holder hung from the hook normally mounted at the side of the back seats of conventional cars.

Subsequently, when the destination is reached, the holder may be used to transfer the garment bag to the hotel room and to hang the garment bag in the closet.

When the traveler leaves on the following morning, the holder may again be grasped to unhook the hook 17 from the closet hanger, such hook retracted and the garment bag carried to a new destination by means of such holder. When the new destination is reached, the noose 19 may easily be loosened by drawing the stop/-slip beads 41 and 38 apart to unlock the bead 25 and permit removal of the hangers 21, the hook 17 pivoted down and the holder itself returned to the traveler's pocket for convenient storage.

From the foregoing it will be appreciated that the garment bag holder of the present invention is economical to manufacture and convenient to use. It is compact to carry and avoids the normal discomfort attendant carrying garment bags by bare hands and the slip noose securely fastens the coat hanger hooks into position thus avoiding unintentional unhooking thereof and consequently wrinkling of garments or, even dropping of the garment bag itself on the ground.

Various modifications and changes may be made with regard to the foregoing detailed description without departing from the spirit of the invention.

I claim:

1. A garment bag holder for a plurality of coat hangers having hanger hooks thereon and comprising:

an elongated rigid handle formed with an elongated central aperture;

a cavity projecting longitudinally from said aperture and opening to one side of said handle;

a pivot pin projecting transversely across said aperture;

an elongated flexible cord connected on one extremity to said pivot pin and projecting from the side of said aperture opposite said one side to form a shank and centrally turned back on itself to dispose the free extremity thereof adjacent and coextensive with said shank;

slip means connecting said free extremity of said cord and shank together to form a closed loop defining a slip noose for receipt of the hanger hooks; and a rigid suspension hook device formed on one end with a turned back hook and on its opposite extremity with a shank terminating in an eye connected to said pivot pin and sized for pivoting about said pivot pin from a position recessed in said cavity projecting longitudinally of said handle to an operative position projecting from said handle to said side opposite said one side whereby a traveler may recess said hook device in said handle, place said holder in his pocket for storage and, when desirable, remove said holder from his pocket and hook said hangers into said noose and grasp said handle to carry garments on said hanger to their dstination and, if desirable, pivot said suspension hook out of said cavity to its operative position to hang said holder from a support.

2. A garment bag holder for a plurality of coat hangers as defined in claim 1 wherein:

the side of said handle facing said loop is scalloped to form finger receiving indentations.

3. A garment bag holder for a plurality of coat hangers as defined in claim 1 wherein:

said hook shank is formed with an eye encircling said pivvot pin; and said noose is connected directly to said eye.

4. A garment bag holder for a plurality of coat hangers as defined in claim 1 wherein:

said slip means includes a slip fitting forming a ring surrounding said shank therethrough and said free extremity is formed with an enlarged-in-cross section having a transverse dimension greater than the opening in said ring to block passage therethrough.

5. A garment bag holder for a plurality of coat hangers as defined in claim 4 wherein:

said noose includes a stop bead threaded centrally over said cord to restrict the central portion of said cord from drawing back through said slip fitting.

6. A garment bag holder for a plurality of coat hangers as defined in claim 1 wherein:

said cord is formed in its free extremity with a knot; and said slip means includes a bead having a bore therethrough for receipt of said coextensive portions and sized to restrict passage of said knot.

* * * * *